US006462013B1

(12) United States Patent
Cooke, Jr. et al.

(10) Patent No.: US 6,462,013 B1
(45) **Date of Patent: *Oct. 8, 2002**

(54) ISOTROPIC LIQUID DETERGENT COMPRISING ETHYLENICALLY UNSATURATED ACID MONOMER-C1 TO C24 CHAIN TRANSFER AGENT POLYMERIZATION PRODUCT

(75) Inventors: Winborn C. Cooke, Jr., Signal Mountain, TN (US); Klein A. Rodrigues, Signal Mountain, TN (US)

(73) Assignee: National Starch and Chemical Investment Holding Corporation, New Castle, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/262,566

(22) Filed: Mar. 4, 1999

Related U.S. Application Data

(63) Continuation of application No. 09/105,577, filed on Jun. 26, 1998, now abandoned.

(51) Int. Cl.[7] ..... C11D 3/37; C11D 17/00

(52) U.S. Cl. ..... 510/475; 510/230; 510/299; 510/318; 510/361; 510/398; 510/400; 510/434; 510/476; 510/533

(58) Field of Search ..... 510/475, 476, 510/318, 361, 434, 533, 299, 400, 528, 230, 398

(56) References Cited

U.S. PATENT DOCUMENTS

| | | | | | |
|---|---|---|---|---|---|
| 4,728,701 | A | * | 3/1988 | Jarvis et al. | 526/65 |
| 4,797,223 | A | * | 1/1989 | Amick et al. | 252/174.23 |
| 5,534,182 | A | * | 7/1996 | Kirk et al. | 8/137 |
| 5,597,509 | A | * | 1/1997 | Kirk et al. | 510/223 |
| 5,719,117 | A | | 2/1998 | Falk et al. | 510/475 |
| 5,723,434 | A | * | 3/1998 | Falk et al. | 510/475 |
| 5,962,398 | A | * | 10/1999 | Vasudevan | 510/470 |
| 2001/0002390 | A1 | * | 5/2001 | Rodrigues | 510/475 |

FOREIGN PATENT DOCUMENTS

| | | | |
|---|---|---|---|
| EP | 0 623 670 | A2 * | 11/1994 |
| EP | 0 786 516 | A2 * | 7/1997 |
| EP | 0 967 266 | A1 * | 12/1999 |

* cited by examiner

*Primary Examiner*—Bruce H. Hess
*Assistant Examiner*—Dawn L. Garrett
(74) *Attorney, Agent, or Firm*—Thomas F. Roland, Esq.

(57) ABSTRACT

An isotropic liquid detergent composition comprising at least one surfactant and from about 0.1 to about 75 weight percent, based on the total weight of the liquid detergent composition, of a water-soluble or water-dispersible polymer having pendant acid functionality and a terminal fragment of a chain transfer agent, wherein the polymer is the polymerization product of a ethylenically unsaturated acid monomer and a $C_1$ to $C_{24}$ chain transfer agent. Unexpectedly, these polymers are compatible in isotropic liquid detergent formulations. When these polymers are used in a laundering process, they remove soil from textiles, inhibit soil redeposition onto textiles, and function as cobuilders by complexing metal ions present in hard water such as calcium and magnesium which otherwise may complex with the surfactants of a liquid detergent rendering the surfactants water-insoluble. Thus, the polymers exhibit a synergistic effect with surfactants of a liquid detergent to solubilize soil stains and suspend dirt particles in a laundering process.

25 Claims, No Drawings

ISOTROPIC LIQUID DETERGENT COMPRISING ETHYLENICALLY UNSATURATED ACID MONOMER-C1 TO C24 CHAIN TRANSFER AGENT POLYMERIZATION PRODUCT

CROSS-REFERENCE TO RELATED APPLICATIONS

This is a continuation-in-part of U.S. patent application Ser. No. 09/105,577, filed Jun. 26, 1998, now abandoned.

FIELD OF THE INVENTION

This invention relates to an isotropic liquid detergent composition comprising a water-soluble or water-dispersible polymer having pendant acid functionality and a terminal fragment of a chain transfer agent.

BACKGROUND OF THE INVENTION

Liquid detergents are generally classified as isotropic liquids or structured liquids. In an isotropic liquid, the components of the liquid system are dissolved into a single phase. In contrast, a structured liquid contains sufficient surfactant and/or electrolyte to form a lamellar droplet comprising "onion" type layers dispersed in an electrolyte medium which is capable of suspending undissolved particles in the liquid. The U.S. detergent market overwhelmingly prefers isotropic liquid detergents which are clear and appear "clean" as opposed to structured liquid detergents which are opague.

European Patent Application 0 786 516 A2 describes isotropic liquid detergent compositions containing a polymer having a hydrophilic backbone and monomer with hydrophobic side chains. The European patent application states the hydrophobic modification allows formation of more stable solutions than otherwise possible. U.S. Pat. No. 5,723,434 describes an isotropic liquid detergent composition containing a polymer having a hydrophilic backbone and monomer with hydrophobic side chains. The U.S. patent determined that the stability of the isotropic detergent increased when the molar ratio of the number of hydrophilic groups to the number of hydrophobic groups on the polymer is below certain critical levels. Thus, the prior art clearly teaches that stable isotropic liquid detergent compositions require a polymer having a hydrophilic backbone and hydrophobic side chains.

In contrast, conventional hydrophilic polymers such as polyacrylates are commonly used in powder detergent compositions wherein they function as cobuilders, antiredeposition agents, and processing agents. However, these hydrophilic polymers have not been incorporated in isotropic liquid detergent compositions because the hydrophilic polymers are not compatible with the organic phase of these formulations. Thus, these polymers cause phase separation in the isotropic liquid detergent formulations which is undesirable. Hence, there is a need for a hydrophilic polymer that is compatible in isotropic liquid detergent compositions.

SUMMARY OF THE INVENTION

The present invention provides an isotropic liquid detergent composition comprising at least one surfactant and from about 0.1 to about 75 weight percent, based on the total weight of the liquid detergent composition, of a water-soluble or water-dispersible polymer having pendant acid functionality and a terminal fragment of a chain transfer agent, wherein the polymer is the polymerization product of a ethylenically unsaturated acid monomer and a $C_1$ to $C_{24}$ chain transfer agent.

According to another aspect the invention provides an isotropic liquid detergent composition comprising at least one surfactant and from about 0.1 to about 75 weight percent, based on the total weight of the liquid detergent composition, of a water-soluble or water-dispersible polymer having pendant acid functionality and a terminal fragment of a chain transfer agent, wherein the polymer is the polymerization product of from about 50 to about 99.9 weight percent, based on the total weight of monomers, of a ethylenically unsaturated acid monomer, from about 0.1 to about 50 weight percent, based on the total weight of monomers, of a ethylenically unsaturated comonomer, and a $C_1$ to $C_{24}$ chain transfer agent.

According to an additional aspect the invention provides a method of cleaning textiles which involves preparing an isotropic liquid detergent composition comprising the water-soluble or water-dispersible polymer, contacting the isotropic liquid detergent composition with one or more textiles, wherein at least one of the textiles contains soil, and removing at least a portion of the soil from the fabric containing soil.

The present inventors have unexpectedly discovered that the water-soluble or water-dispersible polymers having pendant acid functionality and a terminal fragment of a $C_1$ to $C_{24}$ chain transfer agent are compatible in isotropic liquid detergent formulations. When these polymers are used in a laundering process, they remove soil from textiles, inhibit soil redeposition onto textiles, and function as cobuilders by complexing metal ions present in hard water such as calcium and magnesium which otherwise may complex with the surfactants of a liquid detergent rendering the surfactants water-insoluble. Thus, the polymers exhibit a synergistic effect with surfactants of a liquid detergent to solubilize soil stains and suspend dirt particles in a laundering process.

DESCRIPTION OF THE INVENTION

This invention provides an isotropic liquid detergent composition. The liquid detergent composition contains at least one surfactant and from about 0. 1 to about 75 weight percent, based on the total weight of the liquid detergent composition, of a water-soluble or water-dispersible polymer having pendant acid functionality and a terminal fragment of a chain transfer agent. Preferably, the liquid detergent composition contains from about 0.5 to about 25 weight percent, more preferably from about 1 to about 10 weight percent of the water-soluble or water-dispersible polymer.

The water-soluble or water-dispersible polymer having pendant acid functionality and a terminal fragment of a chain transfer agent is the polymerization product of a ethylenically unsaturated acid monomer and a $C_1$ to $C_{24}$ chain transfer agent. Alternatively, the polymer having pendant acid functionality and a terminal fragment of a chain transfer agent is the polymerization product of from about 50 to about 99 weight percent, based on the total weight of monomers, of a ethylenically unsaturated acid monomer, from about 0.1 to about 50 weight percent, based on the total weight of monomers, of a ethylenically unsaturated comonomer, and a $C_1$ to $C_{24}$ chain transfer agent. Preferably, the polymer having pendant acid functionality and a terminal fragment of a chain transfer agent is the polymerization product of from about 60 to about 90 weight percent of the ethylenically unsaturated acid monomer and from about 10 to about 40 weight percent of the ethylenically unsaturated comonomer. More preferably, the polymer having pendant acid functionality and a terminal fragment of a chain transfer agent is the polymerization product of from about 70 to about 80 weight percent of the ethylenically unsaturated acid monomer and from about 20 to about 30 weight percent of the ethylenically unsaturated comonomer.

The polymer having pendant acid functionality and a terminal fragment of a chain transfer agent comprises a hydrophilic "backbone" component which is prepared from at least one monomer as discussed above and a "terminal" portion which is a fragment of a chain transfer agent. The hydrophilic backbone generally is a linear or branched molecular composition preferably containing one type of relatively hydrophilic monomer unit wherein the monomer is preferably sufficiently soluble to form at least a 1% by weight solution when dissolved in water. The only limitation to the structure of the hydrophilic backbone is that a polymer corresponding to the hydrophilic backbone made from the backbone monomeric constituents is relatively water soluble (solubility in water at ambient temperature and at pH of 3.0 to 12.5 is preferably more than 1 g/l). The hydrophilic backbone is also preferably predominantly linear, e.g., the main chain of backbone constitutes at least 50% by weight, preferably more than 75%, most preferably more than 90% by weight. The terminal portion of the polymer is a linear or branched hydrophobe.

The ethylenically unsaturated acid monomer is selected from unsaturated dicarboxylic acids, unsaturated carboxylic acids, sulfonic acids, and phosphonic acids. Combinations of ethylenically unsaturated acid monomers can also be used. Suitable ethylenically unsaturated acid monomers are, for example, acrylic acid, methacrylic acid, ethacrylic acid, alpha-chloro-acrylic acid, alpha-cyano acrylic acid, beta methyl-acrylic acid (crotonic acid), alpha-phenyl acrylic acid, beta-acryloxy propionic acid, sorbic acid, alpha-chloro sorbic acid, angelic acid, cinnamic acid, p-chloro cinnamic acid, beta-styryl acrylic acid (1-carboxy-4-phenyl butadiene-1,3), itaconic acid, maleic acid, maleic anhydride, citraconic acid, mesaconic acid, glutaconic acid, aconitic acid, fumaric acid, tricarboxy ethylene, 2-acryloxypropionic acid, 2-acrylamido-2-methyl propane sulfonic acid, vinyl sulfonic acid, vinyl phosphonic acid, sodium methallyl sulfonate, sulfonated styrene, and allyloxybenzenesulfonic acid. Preferably, the ethylenically unsaturated acid monomer is selected from acrylic acid and itaconic acid.

Optionally an ethylenically unsaturated comonomer may be included with the ethylenically unsaturated acid monomer. The ethylenically unsaturated comonomer is distinguished from the ethylenically unsaturated acid monomer in that the ethylenically unsaturated comonomer does not contain an acid functional group. However, the ethylenically unsaturated comonomer may contain other functional groups such as hydroxy and/or amide groups. The ethylenically unsaturated comonomer is selected from anhydrides, vinyl esters, alkyl esters of acrylic and methacrylic acid, substituted or unsubstituted mono and dialkyl esters of unsaturated dicarboxylic acids or carboxylic acids, vinyl aromatics, unsubstituted or substituted acrylamides, cyclic monomers, monomers containing alkoxylated side chains, α-olefins, and vinyl amide monomers. A combination of ethylenically unsaturated comonomers may also be used.

Suitable anhydride monomers are, for example, maleic anhydride and itaconic anhydride. Suitable vinyl esters are, for example, vinyl acetate, vinyl formate, vinyl propionate, vinyl butyrate, vinyl isobutyrate, vinyl valerate, vinyl 2-ethyl-hexanoate, etc. Suitable alkyl esters of acrylic and methacrylic acid are, for example, methyl acrylate, ethyl acrylate, n-propyl acrylate, isopropyl acrylate, n-butyl acrylate, isobutyl acrylate, t-butyl acrylate, isobornyl acrylate, pentyl acrylate, hexyl acrylate, octyl acrylate, iso-octyl acrylate, nonyl acrylate, lauryl acrylate, stearyl acrylate, eicosyl acrylate, 2-ethylhexyl acrylate, cyclohexyl acrylate, cycloheptyl acrylate, methyl methacrylate, ethyl methacrylate, propyl methacrylate, n-butyl methacrylate, t-butyl methacrylate, isobutyl methacrylate, pentyl methacrylate, hexyl methacrylate, cyclohexyl methacrylate, 2-ethylhexyl methacrylate, isobornyl methacrylate, heptyl methacrylate, cycloheptyl methacrylate, octyl methacrylate, iso-octyl methacrylate, nonyl methacrylate, decyl methacrylate, lauryl methacrylate, eicosyl methacrylate, etc.

Suitable substituted or unsubstituted mono and dialkyl esters of unsaturated dicarboxylic acids or carboxylic acids are, for example, substituted and unsubstituted mono and dibutyl, mono and diethyl maleate esters as well as the corresponding fumarates. Suitable vinyl aromatic monomers are, for example, 3-isopropenyl-α, α-dimethylbenzyl isocyanate, and halogenated styrenes. Suitable acrylamide based monomers are, for example, acrylamide, N, N dimethyl-acrylamide, N-octyl acrylamide, N-methylol acrylamide, dimethylaminoethyl-acrylate, etc. Suitable cyclic monomers are, for example, vinyl pyrrolidone, vinyl imidazolidone, vinyl pyridine, etc. Suitable vinyl amide monomers are, for example, N-vinyl formamide, N-vinyl acetamide, etc. Suitable α-olefin based monomers are, for example, $C_4$ to $C_{20}$ based alkyl monomers such as 1-octene, butylene, 1 dodecene, etc. The ethylenically unsaturated comonomer is preferably acrylamide or vinyl acetate.

The chain transfer agent has from 1 to 24 carbon atoms, preferably 1 to 14 carbon atoms, more preferably 3 to 12 carbon atoms. The chain transfer agent is selected from mercaptans or thiols, amines and alcohols. A combination of chain transfer agents can also be used. Mercaptans useful in this invention are organic mercaptans which contain at least one—SH or thiol group and which are classified as aliphatic, cycloaliphatic, or aromatic mercaptans. The mercaptans can contain other substituents in addition to hydrocarbon groups, such substituents including carboxylic acid groups, hydroxyl groups, ether groups, ester groups, sulfide groups, amine groups and amide groups. Suitable mercaptans are, for example, methyl mercaptan, ethyl mercaptan, butyl mercaptan, mercaptoethanol, mercaptopropanol, mercaptobutanol, mercaptoacetic acid, mercaptopropionic acid, thiomalic acid, benzyl mercaptan, phenyl mercaptan, cyclohexyl mercaptan, 1-thioglycerol, 2,2'-dimercaptodiethyl ether, 2,2'-dimercaptodipropyl ether, 2,2'-dimercaptodiisopropyl ether, 3,3'-dimercaptodipropyl ether, 2,2'-dimercaptodiethyl sulfide, 3,3'-dimercaptodipropyl sulfide, bis(beta-mercaptoethoxy) methane, bis(beta—mercaptoethylthio)methane, ethanedithiol-1,2, propanedithiol-1,2, butanedithiol-1,4, 3,4-dimercaptobutanol-1, trimethylolethane tri(3-mercaptopropionate), pentaerythritol tetra(3-mercapto-propionate), trimethylolpropane trithioglycolate, pentaerythritol tetrathio-glycolate, octanethiol, decanethiol, dodecanethiol, and octadecylthiol. Preferred mercaptan chain transfer agents include 3-mercaptopropionic acid and dodecanediol.

Suitable amines which are useful as chain transfer agents are, for example, methylamine, ethylamine, isopropylamine, n-butylamine, n-propylamine, iso-butylamine, t-butylamine, pentylamine, hexylamine, benzylamine, octylamine, decylamine, dodecylamine, and octadecylamine. A preferred amine chain transfer agent is isopropyl amine and dodecylamine.

Suitable alcohols which are useful as chain transfer agents are, for example, methanol, ethanol, isopropanol, n-butanol, n-propanol, iso-butanol, t-butanol, pentanol, hexanol, benzyl alcohol, octanol, decanol, dodecanol, and octadecanol. A preferred alcohol chain transfer agent is isopropanol and dodecanol.

The chain transfer agent is present in an amount of from about 0.001 to about 50 mole percent, based on the total moles of monomer. Preferably, the chain transfer agent is present in an amount of from about 0.01 to about 10 mole percent, more preferably from about 0.1 to about 5 mole percent, based on the total moles of monomer.

The water-soluble or water-dispersible polymer having pendant acid functionality and a terminal fragment of a chain transfer agent can be prepared by any of the known polymerization processes such as emulsion, suspension, solution or bulk polymerization. Such polymerization processes are well known in the art. In a preferred embodiment, the polymers are prepared by solution polymerization in water. In another preferred embodiment, especially where the ethylenically unsaturated comonomer is not water-soluble, the polymers are prepared by solution polymerization in a water and alcohol mixture wherein the alcohol functions as the chain transfer agent as well as the cosolvent. The alcohol cosolvent may be removed at the end of the polymerization reaction by distillation prior to or following neutralization.

The water-soluble or water-dispersible polymer having pendant acid functionality and a terminal fragment of a chain transfer agent may be neutralized or partially neutralized with an alkali or alkali metal to form an alkaline salt. Examples of alkali or alkali metals are sodium, potassium, cesium, ethanolamine, diethanolamine, triethanolamine, etc. Preferably, the polymer is 50% to 100% neutralized, more preferably, 80% to 90% neutralized.

The isotropic liquid detergent compositions contain one or more surfactants selected from anionic, nonionic, cationic, amphoteric, and zwitterionic surfactants. The preferred surfactants for use in the isotropic liquid detergent compositions are mixtures of anionic and nonionic surfactants although it is to be understood that any surfactant may be used alone or in combination with any other surfactant or surfactants.

Anionic surfactants which may be used in the isotropic liquid detergent compositions are those surfactants which contain a long chain hydrocarbon hydrophobic group in their molecular structure and a hydrophile group, i.e., water solubilizing group such as carboxylate, sulfonate or sulfate group or their corresponding acid form. The anionic surfactants include the alkali metal (e.g., sodium and potassium) water soluble higher alkyl aryl sulfonates, alkyl sulfonates, alkyl sulfates and the alkyl poly ether sulfates. They may also include fatty acid or fatty acid soaps. One of the preferred groups of anionic surfactants are the alkali metal, ammonium or alkanolamine salts of higher alkyl aryl sulfonates and alkali metal, ammonium or alkanolamine salts of higher alkyl sulfates. Preferred higher alkyl sulfates are those in which the alkyl groups contain 8 to 26 carbon atoms, preferably 12 to 22 carbon atoms and more preferably 14 to 18 carbon atoms. The alkyl group in the alkyl aryl sulfonate preferably contains 8 to 16 carbon atoms and more preferably 10 to 15 carbon atoms. A particularly preferred alkyl aryl sulfonate is the sodium potassium or ethanolamine $C_{10}$ to $C_{16}$ benzene sulfonate, e.g., sodium linear dodecyl benzene sulfonate. The primary and secondary alkyl sulfates can be made by reacting long chain alpha-olefins with sulfites or bisulfites, e.g., sodium bisulfite. The alkyl sulfonates can also be made by reacting long chain normal paraffin hydrocarbons with sulfur dioxide and oxygen as described in U.S. Pat. Nos. 2,503,280, 2,507,088, 3,372,188 and 3,260,741 to obtain normal or secondary higher alkyl sulfates suitable for use as surfactant detergents.

The alkyl substituent is preferably linear, i.e., normal alkyl, however, branched chain alkyl sulfonates can be employed, although they are not as good with respect to biodegradability. The alkane, i.e., alkyl, substituent may be terminally sulfonated or may be joined, for example, to the 2-carbon atom of the chain, i.e., may be a secondary sulfonate. It is understood in the art that the substituent may be joined to any carbon on the alkyl chain. The higher alkyl sulfoantes can be used as the alkali metal salts, such as sodium and potassium. The preferred salts are the sodium salts. The preferred alkyl sulfonates are the $C_{10}$ to $C_{18}$ primary normal alkyl sodium and potassium sulfonates, with the $C_{10}$ to $C_{15}$ primary normal alkyl sulfonate salt being more preferred.

Mixtures of higher alkyl benzene sulfonates and higher alkyl sulfates can be used as well as mixtures of higher alkyl benzene sulfonates and higher alkyl polyether sulfates. The alkali metal or ethanolamine alkyl aryl sulfonate can be used in an amount of 0 to 70%, preferably 5 to 50% and more preferably 5 to 15% by weight. The alkali metal or ethanolamine sulfate can be used in admixture with the alkylbenzene sulfonate in an amount of 0 to 70%, preferably 5 to 50% by weight. Also normal alkyl and branched chain alkyl sulfates (e.g., primary alkyl sulfates) may be used as the anionic component.

The higher alkyl polyethoxy sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkyl polyethoxy sulfates used in accordance with the present invention are represented by the formula:

$$R^1—O(CH_2CH_2O)_p—SO_3M,$$

where $R^1$ is $C_8$ to $C_{20}$ alkyl, preferably $C_{10}$ to $C_{18}$ and more preferably $C_{12}$ to $C_{15}$; p is 2 to 8, preferably 2 to 6, and more preferably 2 to 4; and M is an alkali metal, such as sodium and potassium, or an ammonium cation. The sodium and potassium salts are preferred.

A preferred higher alkyl poly ethoxylated sulfate is the sodium salt of a triethoxy $C_{12}$ to $C_{15}$ alcohol sulfate having the formula:

$$C_{12\text{-}15}—O—(CH_2CH_2O)_3—SO_3Na$$

Examples of suitable alkyl ethoxy sulfates that can be used in accordance with the present invention are $C_{12\text{-}15}$ normal or primary alkyl triethoxy sulfate, sodium salt; n-decyl diethoxy sulfate, sodium salt; $C_{12}$ primary alkyl diethoxy sulfate, ammonium salt; $C_{12}$ primary alkyl triethoxy sulfate, sodium salt; $C_{15}$ primary alkyl tetraethoxy sulfate, sodium salt; mixed $C_{14\text{-}15}$ normal primary alkyl mixed tri- and tetraethoxy sulfate, sodium salt; stearyl pentaethoxy sulfate, sodium salt; and mixed $C_{10\text{-}18}$ normal primary alkyl triethoxy sulfate, potassium salt.

The normal alkyl ethoxy sulfates are readily biodegradable and are preferred. The alkyl poly-lower alkoxy sulfates can be used in mixtures with each other and/or in mixtures with the above discussed higher alkyl benzene, sulfonates, or alkyl sulfates.

The alkali metal higher alkyl poly ethoxy sulfate can be used with the alkylbenzene sulfonate and/or with an alkyl sulfate, in an amount of 0 to 70%, preferably 5 to 50% and more preferably 5 to 20% by weight of entire composition.

Nonionic surfactants which can be used in the isotropic liquid detergent compositions, alone or in combination with other surfactants, are characterized by the presence of a hydrophobic group and an organic hydrophilic group and are typically produced by the condensation of an organic aliphatic or alkyl aromatic hydrophobic compound with ethylene oxide (hydrophilic in nature). Suitable nonionic surfactants are those disclosed in U.S. Pat. Nos. 4,316,812 and 3,630,929.

Usually, the nonionic surfactants are polyalkoxylated lipophiles wherein the desired hydrophile-lipophile balance is obtained from addition of a hydrophilic poly-lower alkoxy group to a lipophilic moiety. A preferred class of nonionic detergent is the alkoxylated alkanols wherein the alkanol is of 9 to 18 carbon atoms and wherein the number of moles of alkylene oxide (or 2 or 3 carbon atoms) is from 3 to 12. Of such materials it is preferred to employ those wherein the alkanol is a fatty alcohol of 9 to 11 or 12 to 15 carbon atoms and which contain from 5 to 8 or 5 to 9 alkoxy groups per mole.

Examples of such compounds are those wherein the alkanol is of 10 to 15 carbon atoms and which contain about 5 to 9 ethylene oxide groups per mole, e.g., Neodol 25-9 and Neodol 23-6.5, which products are made by Shell Chemical Company, Inc. The former is a condensation product of a mixture of higher fatty alcohols averaging about 12 to 15 carbon atoms, with about 9 moles of ethylene oxide and the latter is a corresponding mixture wherein the carbon atoms content of the higher fatty alcohol is 12 to 13 and the number of ethylene oxide groups present averages about 6.5. The higher alcohols are primary alkanols.

Another subclass of alkoxylated surfactants which can be used contain a precise alkyl chain length rather than an alkyl chain distribution of the alkoxylated surfactants described above. Typically, these are referred to as narrow range alkoxylates. Examples of these include the Neodol-1® series of surfactants manufactured by Shell Chemical Company.

Other useful nonionics are represented by the commercially well known class of nonionics sold under the trademark Plurafac by BASF. The Plurafacs are the reaction products of a higher linear alcohol and a mixture of ethylene and propylene oxides, containing a mixed chain of ethylene oxide and propylene oxide, terminated by a hydroxyl group. Examples include $C_{13}$–$C_{15}$ fatty alcohol condensed with 6 moles ethylene oxide and 3 moles propylene oxide, $C_{13}$–$C_{15}$ fatty alcohol condensed with 7 moles propylene oxide and 4 moles ethylene oxide, $C_{13}$–$C_{15}$ fatty alcohol condensed with 5 moles propylene oxide and 10 moles ethylene oxide or mixtures of any of the above.

Another group of liquid nonionic surfactants are commercially available from Shell Chemical Company, Inc., under the Dobanol or Neodol trademark: Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles ethylene oxide per mole of fatty alcohol.

Preferred nonionic surfactants are the $C_{12}$–$C_{15}$ primary fatty alcohols with relatively narrow contents of ethylene oxide in the range of from about 6 to 9 moles, and the $C_9$–$C_{11}$ fatty alcohols ethoxylated with about 5 to 6 moles ethylene oxide.

Another class of nonionic surfactants which can be used in the isotropic liquid detergent compositions are glycoside surfactants which include those of the formula:

$$RO—R^1O—_y(Z)_x$$

wherein R is a monovalent organic radical containing from about 6 to about 30 (preferably from about 8 to about 18) carbon atoms; $R^1$ is a divalent hydrocarbon radical containing from about 2 to 4 carbons atoms; O is an oxygen atom; y is a number which can have an average value of from 0 to about 12 but which is most preferably zero; Z is a moiety derived from a reducing saccharide containing 5 or 6 carbon atoms; and x is a number having an average value of from 1 to about 10 (preferably from about 1½ to about 10).

A particularly preferred group of glycoside surfactants includes those of the formula above in which R is a monovalent organic radical (linear or branched) containing from about 6 to about 18 (especially from about 8 to about 18) carbon atoms; y is zero; z is glucose or a moiety derived therefrom; x is a number having an average value of from 1 to about 4 (preferably from about 1½ to 4).

Nonionic surfactants which may be used include polyhydroxy amides as discussed in U.S. Pat. No. 5,312,954 and aldobionamides such as disclosed in U.S. Pat. No. 5,389,279, both of which are hereby incorporated herein by reference. The amount of nonionic surfactants is from about 0 to about 50 weight percent, preferably 5 to 40 weight percent, more preferably 5 to 25 weight percent, based on the weight of the isotropic liquid detergent composition.

Many cationic surfactants are known in the art, and almost any cationic surfactant having at least one long chain alkyl group of about 10 to 24 carbon atoms is suitable in the isotropic liquid detergent compositions. Specific cationic surfactants are described in U.S. Pat. No. 4,497,718, which is hereby incorporated herein by reference. The cationic surfactants may be used alone or in combination with any of the other surfactants known in the art. Of course, the compositions may contain no cationic surfactants at all.

Amphoteric surfactants can be broadly described as derivatives of aliphatic or aliphatic derivatives of heterocyclic secondary and tertiary amines in which the aliphatic radical may be straight chain or branched and wherein one of the aliphatic substituents contains from about 8 to 18 carbon atoms and at least one contains an anionic water-soluble group, e.g., carboxylate, sulfonate, sulfate. Examples of compounds falling within this definition are sodium 3-(dodecylamino)propionate, sodium 3-(dodecylamino)propane-1-sulfonate, sodium 2-dodecylamino)ethyl sulfate, sodium 2-(dimethylamino) octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. Sodium 3-(dodecylamino)-propane-1-sulfonate is preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water-solubilizing group, e.g., carboxy, sulfonate, sulfate, phosphae, or phosphonate.

Specific examples of zwitterionic surfactants which may be used are described in U.S. Pat. No. 4,062,647, which is hereby incorporated herein by reference.

Particularly preferred surfactant systems include, for example, mixtures of linear alkyl aryl sulfonates (LAS) and linear alkoxylated (e.g., ethoxylated) sulfates (AES) with alkoxylated nonionics. The amount of surfactant used in the isotropic liquid detergent compositions may vary from 1 to 85 weight percent, preferably 10 to 50 weight percent, based on the weight of the isotropic liquid detergent composition.

The isotropic liquid detergent compositions may further comprise at least one additive. Suitable additives may include, for example, ion exchangers, alkalies, anticorrosion materials, antiredeposition materials, antistatic agents, optical brighteners, perfumes, fragrances, dyes, fillers, oils, chelating agents, enzymes, fabric whiteners, brighteners, sudsing control agents, solvents, hydrotropes, bleaching agents, bleach precursors, buffering agents, soil removal agents, soil release agents, fabric softening agents, and opacifiers. In general, such additives and their amounts are known to those skilled in the art, therefore, only a limited number of additives will be referred to in more detail.

The isotropic liquid detergent compositions may be pH jump compositions. A pH jump heavy duty liquid (HDL) is a liquid detergent composition containing a system of components designed to adjust the pH of the wash liquor. To achieve the required pH regimes, a pH jump system can be employed in this invention to keep the pH of the product low for enzyme stability in multiple enzyme systems (e.g., protease and lipase systems) yet allow it to become moderately high in the wash for detergency efficacy. One such system is borax $10H_2O$/polyol. Borate ion and certain cis 1,2 polyols complex when concentrated to cause a reduction in pH. Upon dilution, the complex dissociates, liberating free borate to raise the pH. Examples of polyols which exhibit this complexing mechanism with borax include catechol, galacitol, fructose, sorbitol and pinacol. For economic reasons, sorbitol is the preferred polyol.

Sorbitol or equivalent component (i.e., 1,2 polyols noted above) is used in the pH jump formulation in an amount from about 1 to 25% by weight, preferably 3 to 15% by weight of the composition.

Borate or boron compound is used in the pH jump composition in an amount from about 0.5 to 10 weight percent of the composition, preferably 1 to 5 weight percent.

The addition of hydrotropes helps to incorporate higher levels of surfactants into isotropic liquid detergents than would otherwise be possible due to phase separation of surfactants from the aqueous phase. Hydrotropes also allow a change in the proportions of different types of surfactants, namely anionic, nonionic, cationic and zwitterionic, without encountering the problem of phase separation. Thus, they increase the formulation flexibility. Hydrotropes function through either of the following mechanisms: i) they increase the solubility of the surfactant in the aqueous phase by changing the solvent power of the aqueous phase; short chain alcohols such as ethanol, isopropanol and also glycerol and propylene glycol are examples in this class and ii) they prevent formation of liquid crystalline phases of surfactants by disrupting the packing of the hydrocarbon chains of the surfactants in the micelles; alkali metal salts of alkyl aryl sulfonates such as xylene sulfonate, cumene sulfonate and alkyl aryl disulfonates such as DOWFAX® family of hydrotropes marketed by Dow Chemicals are examples in this case.

The hydrotropes may be present in an amount from about 1 to about 25 weight percent, preferably 1 to 10 weight percent, based on the total weight of the isotropic liquid detergent composition.

The isotropic liquid detergent compositions may further contain an aliphatic hydrocarbon oil which is believed to make the compositions more hydrophobic and so help the stability (i.e., clarity) of the solution. The aliphatic group is a saturated or unsaturated, straight or branch chained hydrocarbon having 5 to 19, preferably 8 to 18 carbons. The molecular weight of these oils will generally be about 50 to about 300. Examples of such oil include, but are not limited to heptanes, octanes, nonanes, decanes, etc., through $C_{18}$; olefines such as octenes, nonenes, through $C_{18}$; and all isomeric variations (e.g., isooctane) thereof. The oil can be used at levels varying from about 0.1 to about 20 weight percent, preferably from about 0.5 to about 10 weight percent, more preferably from about 0.5 to about 5 weight percent, based on the weight of the composition.

Builders which can be used in the isotropic liquid detergent composition include conventional alkaline detergency builders, inorganic or organic, which should be used at levels from about 0.1 to about 20 weight percent, preferably from about 1 to about 10 weight percent, more preferably 2 to 5 weight percent, based on the weight of the composition.

The isotropic liquid detergent compositions may also include an electrolyte such as any water-soluble salt. The electrolyte may also be a detergency builder, such as the inorganic builder sodium tripolyphosphate, or it may be a non-functional electrolyte such as sodium sulfate or chloride.

Examples of suitable inorganic alkaline detergency builders which may be used are water-soluble alkali metal phosphates, polyphosphates, borates, silicates and also carbonates. Specific examples of such salts are sodium and potassium triphosphates, pyrophospates, orthophosphates, hexameta-phosphates, tetraborates, silicates and carbonates.

Examples of suitable organic alkaline detergency builder salts are: (1) water-soluble amino polycarboxylates, e.g., sodium and potassium ethylenediaminetetraacetates, nitrilotriacetates and N-(2 hydroyethyl)-nitrilodiacetates; (2) water-soluble salts of phytic acid, e.g., sodium and potassium phytates (see U.S. Pat. No. 2,379,942) (3); water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid hydroxymethanediphosphonic acid, carboxyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,2,1,3-tetraphosphonic acid, and propane-1,2,2,3-tetraphosphonic acid.

Certain zeolites or aluminosilicates can be used. One such aluminosilicate which is useful in the compositions of the invention is an amorphous water-insoluble hydrated compound of the formula $Na_x(AlO_2\ SiO_2)$, wherein x is a number from 1.0 to 1.2 and y is 1, said amorphous material being further characterized by a Mg++ exchange capacity of from about 50 mg eq. $CaCO_3$/g and a particle diameter of from about 0.01 micron to about 5 microns. This ion exchange builder is more fully described in British Patent No. 1,470,250.

A second water-insoluble synthetic aluminosilicate ion exchange material useful herein is crystalline in nature and has the formula $Na_2[(AlO_2)_y\ (SiO_2)]xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium exchange rate on an anhydrous basis of at least about 2 grams/gallon/minute/gram. These synthetic aluminosilicates are more fully described in British Patent No. 1,429,143.

The isotropic liquid detergent compositions may include one or more enzymes. Such enzymes include, for example, lipases, proteases, amylases, peroxidases and the like which are well known in the art. The enzymes may be used together with cofactors required to promote enzyme activity. It should also be understood that enzymes having mutations at various positions (e.g., enzymes engineered for performance and/or stability enhancement) are also contemplated by the invention.

The enzyme stabilization system may comprise calcium ion; boric acid, propylene glycol and/or short chain carboxylic acids. The composition preferably contains from about 0.01 to about 50, preferably from about 0. to about 30, more preferably from about 1 to about 20 millimoles of calcium ion per liter.

When calcium ion is used, the level of calcium ion should be selected so that there is always some minimum level available for the enzyme after allowing for complexation with builders, etc., in the composition. Any water-soluble calcium salt can be used as the source of calcium ion, including calcium chloride, calcium formate, calcium acetate and calcium propionate. A small amount of calcium ion, generally from about 0.05 to about 2.5 millimoles per liter, is often also present in the composition due to calcium in the enzyme slurry and formula water.

Another enzyme stabilizer which may be used in propionic acid or a propionic acid salt capable of forming propionic acid. When used, this stabilizer may be used in an amount from about 0.1% to about 15% by weight of the composition.

Another preferred enzyme stabilizer is polyols containing only carbon, hydrogen and oxygen atoms. They preferably contain from 2 to 6 carbon atoms and from 2 to 6 hydroxy groups. Examples include propylene glycol, especially 1,2 propane diol which is preferred, ethylene glycol, glycerol, sorbitol, mannitol and glucose. The polyol generally represents from about 0.1 to 25% by weight, preferably about 1.0% to about 15%, more preferably from about 2% to about 8% by weight of the composition.

The composition herein may also optionally contain from about 0.25% to about 5%, most preferably from about 0.5% to about 3% by weight of boric acid. The boric acid may be, but is preferably not, formed by a compound capable of forming boric acid in the composition. Boric acid is preferred, although other compounds such as boric oxide, borax and other alkali metal borates (e.g., sodium ortho-, meta- and pyroborate and sodium pentaborate) are suitable. Substituted boric acids (e.g., phenylboronic acid, butane boronic acid and a p-bromo phenylboronic acid) can also be used in place of boric acid.

One preferred stabilization system is a polyol in combination with boric acid. Preferably, the weight ratio of polyol to boric acid added is at least 1, more preferably at least about 1.3.

Another preferred stabilization system is the pH jump system such as is taught in U.S. Pat. No. 5,089,163 to Aronson et al., hereby incorporated by reference into the subject application.

Alkalinity buffers which may be added to the compositions of the invention include monoethanolamine, triethanolamine, borax and the like.

Other materials such as clays, particularly of the water-insoluble types, may be useful adjuncts in compositions of this invention. A particularly useful clay bentonite.

In addition, various other detergent additives or adjuvants may be present in the detergent product to give it additional desired properties, either of functional or aesthetic nature.

Improvements in the physical stability and anti-settling properties of the composition may be achieved by the addition of a small effective amount of an aluminum salt of a higher fatty acid, e.g., aluminum stearate, to the composition. The aluminum stearate stabilizing agent can be added in an amount of 0 to about 3 weight percent, preferably from about 0.1 to about 2 weight percent, and more preferably from about 0.5 to about 1.5 weight percent, based on the weight of the isotropic liquid detergent composition.

Optical brighteners for cotton, polyamide and polyester textiles can be used. Suitable optical brighteners include Tinopal LMS-X, stilbene, triazole and benzidine sulfone compositions, especially sulfonated substituted triazinyl stilbene, sulfonated naphthotriazole stilbene, benzidene sulfone, etc., most preferred are stilbene and triazole combinations. A preferred brightener is Stilbene Brightener N4 which is a dimorpholine dianilino stilbene sulfonate.

Anti-foam agents, e.g., silicon compounds, such as Silicane L 7604, can also be added in small effective amounts.

Bactericides, e.g., tetrachlorosalicylanilide and hexachlorophene, fungicides, dyes, pigments (water dispersible), preservatives, e.g., formalin, ultraviolet absorbers, anti-yellowing agents, such as sodium carboxymethyl cellulose, pH modifiers and pH buffers, color safe bleaches, perfume and dyes and bluing agents such as Iragon Blue L2D, Detergent Blue 472/572 and ultramarine blue can be used.

The following nonlimiting examples illustrate further aspects of the invention.

EXAMPLE 1

311.5 grams of water was added to a 2 liter reaction vessel and heated to 96° C. 398.6 grams of acrylic acid were slowly added to the reactor using a pump over a three hour period. Also, 33.9 grams of 3-mercaptopropionic acid was dissolved in 44 grams of water and fed into the reactor over a three hour period of time concurrent with the acrylic acid feed. 6.2 grams of sodium persulfate was dissolved in 41 grams of water and added to the reactor over a period of three hours and 15 minutes concurrent with the acrylic acid feed, except for the additional 15 minutes to react any residual monomer. The reaction mixture was held at 96° C. for 30 minutes and subsequently cooled to 90° C.

A 0.7 gram solution of tert-butyl hydroperoxide (70 weight percent) followed by a 1.8 grams solution of sodium bisulfite (41 weight percent) were slowly added to the reactor. The reaction mixture was held at 96° C. for 30 minutes and then cooled to 85° C. A solution of 35 weight percent hydrogen peroxide weighing 7.2 grams was then added to the reactor. The reaction mixture was cooled and 30.6 grams of water and 0.4 grams of a 50 weight percent solution of sodium hydroxide was added to reactor with cooling. The final polymer solution was a viscous liquid having a solids content of approximately 50 weight percent and having a pH of 2.7.

A solution of the polymer weighing 38.3 grams was neutralized with 16.1 grams of 50 weight percent sodium hydroxide to a pH of 7.5. The neutralized polymer solution was a clear viscous liquid having a solids content of approximately 43 weight percent.

EXAMPLE 2

A sample of itaconic acid weighing 72 grams was stirred into 311.5 grams of water in a 2 liter reaction vessel and heated to 96° C. The solid itaconic acid was completely dissolved during the heating process. 358.7 grams of acrylic acid were slowly added to the reactor using a pump over a three hour period. Also, 33.9 grams of 3-mercaptopropionic acid was dissolved in 44 grams of water and fed into the reactor over three hours concurrent to the acrylic acid feed. 6.2 grams of sodium persulfate was dissolved in 41 grams of water and added to the reactor over a period of three hours and 15 minutes concurrent with the acrylic acid feed, except for the additional 15 minutes to react any residual monomer. The reaction mixture was held at 96° C. for 30 minutes and subsequently cooled to 90° C. A 0.7 gram solution of tert-butyl hydroperoxide (70 weight percent) followed by a 1.8 grams solution of sodium bisulfite (41 weight percent) were slowly added to the reactor. The reaction mixture was held at 96° C. for 30 minutes and then cooled to 85° C. A solution of 35 weight percent hydrogen peroxide weighing 7.2 grams was then added to the reactor. The reaction mixture was cooled and 30.6 grams of water and 443 grams of a 50 weight percent solution of sodium hydroxide was added to reactor with cooling. The final polymer solution was a clear viscous liquid.

EXAMPLE 3

A sample of itaconic acid weighing 144 grams was stirred into 311.5 grams of water in a two liter reaction vessel and heated to 96° C. The solid itaconic acid was completely dissolved during the heating process. 319 grams of acrylic acid were slowly added to the reactor using a pump over a three hour period. Also, 33.9 grams of 3-mercaptopropionic acid was dissolved in 41 grams of water and fed in to the reactor over three hours concurrent to the acrylic acid feed. 6.2 grams of sodium persulfate was dissolved in 75 grams of water and added to the reactor over a period of three hours and 15 minutes concurrent with the acrylic acid feed, except for the additional 15 minutes to react any residual monomer. The reaction mixture was held at 96° C. for 30 minutes and subsequently cooled to 90° C. A 0.7 gram solution of tert-butyl hydroperoxide (70 weight percent) followed by a 1.8 grams solution of sodium bisulfite (41 weight percent) were slowly added to the reactor. The reaction mixture was held at 96° C. for 30 minutes and then cooled to 85° C. A solution of 35 weight percent hydrogen peroxide weighing 7.2 grams was then added to the reactor. The reaction mixture was cooled and 30.6 grams of water and 443 grams of a 50 weight percent solution of sodium hydroxide was added to reactor with cooling. The final polymer solution was a clear viscous liquid with a solids content of approximately 44 weight percent and a pH of 6.7.

EXAMPLE 4

The polymers prepared in Examples 1–3 and ALCOSPERSE 602N, available from ALCO Chemical, which is a polyacrylate typically used in powdered detergent applications, were evaluated for compatibility with FAB liquid detergent which is commercially available from Colgate. Also, the ability of these polymers to function as a cobuilders was determined by measuring the calcium binding capability. The test results are summarized in Table I.

TABLE I

Compatibility and calcium binding test results for a series of polymers in Colgate's Liquid FAB formulation.

| POLYMER | Calcium binding capability mg $CACO_3$/g of polymer | Compatibility with FAB Liquid (1% dry polymer/FAB) | COMPATIBILITY with FAB Liquid (2% dry polymer/FAB) |
|---|---|---|---|
| ALCOSPERSE-602N | 336.0 | — | Opaque solution |
| Example 1 | 188.1 | Clear solution | Slightly hazy solution |
| Example 2 | 276.1 | Very clear solution | Very clear solution |
| Example 3 | 392.0 | Very clear solution | Clear solution |

The test results in Table I clearly indicate that the water-soluble or water-dispersible polymers having pendant acid functionality and a terminal fragment of a chain transfer agent which were prepared according to the present invention are extremely compatible in typical commercial liquid formulations such as FAB, as compared to conventional hydrophilic polymers such as a polyacrylate. In addition, the test results in Table I show that the polymers of the present invention exhibit excellent calcium binding properties.

EXAMPLE 5

Isotropic liquid detergent compositions were prepared according to Table II. The compatibility of the isotropic liquid detergent compositions was evaluated by the clarity of the solutions after the ingredients were mixed together in the order listed in Table II.

TABLE II

Isotropic Liquid Detergent Compositions

| Ingredients | Composition 1 | Composition 2 | Composition 3 |
|---|---|---|---|
| Water | 65.7 | 65.7 | 65.7 |
| sodium citrate | 4.3 | 4.3 | 4.3 |
| propylene glycol | 2.4 | 2.4 | 2.4 |
| sodium xylene sulfonate | 2.2 | 2.2 | 2.2 |
| DOWFAX hydrotrope surfactant (50%) | 1.1 | 1.1 | 1.1 |
| sodium dodecylbenzene sulfonate (40%) | 13.7 | 13.7 | 13.7 |
| $C_{12}$—$C_{15}$ alcohol with 9 moles of ethoxylation | 5.9 | 5.9 | 5.9 |
| Polymer of Example 1 | 4.7 | | |
| Polymer of Example 2 | | 4.7 | |
| Polymer of Example 3 | | | 4.7 |
| Result | almost clear solution | very clear solution | very clear solution |

The data in Table II clearly shows that the water-soluble or water-dispersible polymers having pendant acid functionality and a terminal fragment of a chain transfer agent which were prepared according to the present invention are compatible in liquid detergent compositions.

EXAMPLE 6

Synthesis of Hydrophobically Modified Polyacrylic Acid with a $C_{12}$ Chain Transfer Agent 524.8 g of water and 174 g of isopropyl alcohol are heated in a reactor to 85° C. A mixture of 374 g of acrylic acid and 49 g of n-dodecylmercaptan were added to the reactor over a period of three hours. After addition was completed, 65.3 g of acrylic acid were added over a period of 30 minutes to the reactor. At the same time, a solution of 17.5 g of sodium persulfate in 175 g of water was also added to the reactor over a period of four hours. The temperature of the reactor is maintained at 85–95° C. for one hour. Then 125 g of water, 51 g of a 50% NaOH solution, and 0.07 g of ANTIFOAM 1400, available from Dow Chemical Company, were added to the reactor. The reaction mixture was distilled to remove the isopropyl alcohol. Approximately 300 g of a mixture of isopropyl alcohol and water were distilled off. The reaction mixture was cooled to room temperature and 388 g of a 50% NaOH solution was added.

EXAMPLE 7

Evaluation of Anti-redeposition Properties

The hydrophobically modified polyacrylic acid with a $C_{12}$ chain transfer agent prepared in Example 6 was evaluated in a detergent composition for antiredeposition properties and compared to a detergent composition without the polymer. The anti-redeposition test was conducted in a terg-o-tometer using three 4×4.5" cotton swatches and three 4×4.5" EMPA 213 (polycotton swatches available from Test Fabrics). Five 4×4" polycotton swatches were used as ballast. The wash cycle was 10 minutes using 0.9 g/L of UNBUILT liquid detergent (composition listed below) and 150 ppm hardness water with a Ca to Mg ratio of 2:1. The soil used was 0.3 g/L rose clay, 0.16 g/L bandy black clay and 0.9 g/L of an oil blend (70% vegetable oil and 30% mineral oil). The polymer and copolymers were dosed at 4 weight percent of the detergent weight. The rinse cycle was 3 minutes using 150 ppm hardness water with a Ca to Mg ratio of 2:1. A total of 3 cycles were carried out and the swatches were dried in a tumble dryer on medium setting. The L a b values before the first cycle and after the third cycle was measured as $L_1$, $a_1$, $b_1$ and $L_2$, $a_2$, $b_2$ respectively.

$$\Delta E=[(L_1-L_2)^2+(a_1-a_2)^2+(b_1-b_2)^2]^{0.5}$$

The UNBUILT liquid detergent contained 22.5 weight percent NEODOL 25-7, 18.8 weight percent BIOSOFT D40, 3 weight percent triethanol amine, 5 weight percent ethanol, 2 weight percent potassium chloride, and 48.8 weight percent water. NEODOL 25-7 is an alcohol ethoxylate containing $C_{12}$–$C_{15}$ alcohol with 7 moles of ethoxylation, available from Shell Chemical Co. BIOSOFT D40 is sodium dodecylbenzene sulfonate, available from Stepan Chemical Co. The test results are summarized in Table II.

TABLE III

| | Anti-Redeposition Test | | | |
|---|---|---|---|---|
| Polymer | ΔE for cotton | Ave ΔE for cotton | Ave ΔE for polycotton | Ave ΔE for polycotton |
| Blank | 3.08 | | 2.37 | |
| | 2.80 | 2.77 | 2.40 | 2.50 |
| | 2.45 | | 2.73 | |
| Polymer of Example 6 | 1.50 | | 0.88 | |
| | 1.30 | 1.45 | 0.87 | 0.90 |
| | 1.55 | | 0.97 | |

The test results in Table III clearly show that the hydrophobically modified polyacrylic acid with a $C_{12}$ chain transfer agent of the invention have superior anti-redeposition properties as compared to detergent formulations without the polymers of the invention.

The present inventors have unexpectedly discovered that the water-soluble or water-dispersible polymers having pendant acid functionality and a terminal fragment of a $C_1$ to $C_{24}$ chain transfer agent are compatible in isotropic liquid detergent formulations. When these polymers are used in a laundering process, they remove soil from textiles, inhibit soil redeposition onto textiles, and function as cobuilders by complexing metal ions present in hard water such as calcium and magnesium which otherwise may complex with the surfactants of a liquid detergent rendering the surfactants water-insoluble. Thus, the polymers exhibit a synergistic effect with surfactants of a liquid detergent to solubilize soil stains and suspend dirt particles in a laundering process.

While the invention has been described with particular reference to certain embodiments thereof, it will be understood that changes and modifications may be made by those of ordinary skill within the scope and spirit of the following claims.

What is claimed is:

1. An isotropic liquid detergent composition comprising at least one surfactant, from 1 to 25 weight percent of at least one hydrotrope based on the total weight of the liquid detergent composition, and from 0.1 to 75 weight percent, based on the total weight of the liquid detergent composition, of a water-soluble or water-dispersible polymer having a hydrophilic backbone component having pendant acid functionality and a terminal hydrophobic fragment of a chain transfer agent, wherein the polymer is the polymerization product of a ethylenically unsaturated acid monomer and a $C_3$ to $C_{24}$ chain transfer agent which is selected from the group consisting of a mercaptan, amine, alcohol, and combinations thereof, provided that the chain transfer agent does not contain a polyalkyleneoxy group, and wherein said liquid detergent consists of a clear, single phase.

2. The isotropic liquid detergent composition according to claim 1 wherein the polymer is present in an amount of from about 0.5 to about 25 weight percent.

3. The isotropic liquid detergent composition according to claim 1 wherein the surfactant is selected from the group consisting of anionic surfactants, nonionic surfactants, cationic surfactants, amphoteric surfactants, and combinations thereof.

4. The isotropic liquid detergent composition according to claim 1 wherein the surfactant comprises a mixture of anionic and nonionic surfactants.

5. The isotropic liquid detergent composition according to claim 1 wherein the ethylenically unsaturated acid monomer is selected from the group consisting of unsaturated dicarboxylic acids, unsaturated carboxylic acids, sulfonic acids, phosphonic acids, and mixtures thereof.

6. The isotropic liquid detergent composition according to claim 5 wherein the ethylenically unsaturated acid monomer is selected from the group consisting of acrylic acid, methacrylic acid, ethacrylic acid, alpha-chloro-acrylic acid, alpha-cyano acrylic acid, beta methyl-acrylic acid (crotonic acid), alpha-phenyl acrylic acid, beta-acryloxy propionic acid, sorbic acid, alpha-chloro sorbic acid, angelic acid, cinnamic acid, p-chloro cinnamic acid, beta-styryl acrylic acid (1-carboxy-4-phenyl butadiene-1,3), itaconic acid, maleic acid, maleic anhydride, citraconic acid, mesaconic acid, glutaconic acid, aconitic acid, fumaric acid, tricarboxy ethylene, 2-acryloxypropionic acid, 2-acrylamido-2-methyl propane sulfonic acid, vinyl sulfonic acid, vinyl phosphonic acid, sodium methallyl sulfonate, sulfonated styrene, allyloxybenzenesulfonic acid, and combinations thereof.

7. The isotropic liquid detergent composition according to claim 6 wherein the ethylenically unsaturated acid monomer is selected from the group consisting of acrylic acid and itaconic acid.

8. The isotropic liquid detergent composition according to claim 1 wherein the mercaptan is selected from the group consisting of methyl mercaptan, ethyl mercaptan, butyl mercaptan, mercaptoethanol, mercaptopropanol, mercaptobutanol, mercaptoacetic acid, mercaptopropionic acid, thiomalic acid, benzyl mercaptan, phenyl mercaptan, cyclohexyl mercaptan, 1-thioglycerol, 2,2'-dimercaptodiethyl ether, 2,2'-dimercaptodipropyl ether, 2,2'-dimercaptodiisopropyl ether, 3,3'-dimercaptodipropyl ether, 2,2'-dimercaptodiethyl sulfide, 3,3'-dimercaptodipropyl sulfide, bis(beta-mercaptoethoxy) methane, bis(beta-mercaptoethylthio)methane, ethanedithiol-1,2, propanedithiol-1,2, butanedithiol-1,4, 3,4-dimercaptobutanol-1, trimethylole-thane tri(3-mercaptopropionate), pentaerythritol tetra(3-mercaptopropionate), trimethylolpropane trithioglycolate, pentaerythritol tetrathioglycolate, octanethiol, decanethiol, dodecanethiol, and octadecylthiol.

9. The isotropic liquid detergent composition according to claim 8 wherein the chain transfer agent is 3-mercaptopropionic acid or dodecanethiol.

10. The isotropic liquid detergent composition according to claim 1 wherein the alcohol is selected from the group consisting of methanol, ethanol, isopropanol, n-butanol, n-propanol, iso-butanol, t-butanol, pentanol, hexanol, and benzyl alcohol.

11. The isotropic liquid detergent composition according to claim 10 wherein the chain transfer agent is isopropyl amine or dodecylamine.

12. The isotropic liquid detergent composition according to claim 1 wherein the alcohol is selected from the group consisting of methanol, ethanol, isopropanol, n-butanol, n-propanol, iso-butanol, t-butanol, pentanol, hexanol, and benzyl alcohol, octanol, decanol, dodecanol, and octadecanol.

13. The isotropic liquid detergent composition according to claim 12 wherein the chain transfer agent is isopropanol or dodecanol.

14. The isotropic liquid detergent composition according to claim 1 wherein the chain transfer agent is present in an amount of from about 0.001 to about 50 mole percent, based on the total moles of monomer.

15. The isotropic liquid detergent composition according to claim 14 wherein the chain transfer agent is present in an amount of from about 0.01 to about 10 mole percent.

16. The isotropic liquid detergent composition according to claim 15 wherein the chain transfer agent is present in an amount of from about 0.1 to about 5 mole percent.

17. The isotropic liquid detergent composition according to claim 1 wherein the chain transfer agent has 1 to 14 carbon atoms.

18. The isotropic liquid detergent composition according to claim 1 wherein the chain transfer agent has 3 to 12 carbon atoms.

19. The isotropic liquid detergent composition according to claim 1 further comprising at least one additive selected from the group consisting of ion exchangers, alkalies, anticorrosion materials, antiredeposition materials, antistatic agents, optical brighteners, perfumes, fragrances, dyes, fillers, oils, chelating agents, enzymes, fabric whiteners, brighteners, sudsing control agents, solvents, hydrotropes, bleaching agents, bleach precursors, buffering agents, soil removal agents, soil release agents, fabric softening agents, and opacifiers.

20. A method of cleaning textiles which involves preparing an isotropic liquid detergent composition comprising a water-soluble or water-dispersible polymer according to claim 1, contacting the liquid detergent composition with one or more textiles, wherein at least one of the textiles contains soil, and removing at least a portion of the soil from the fabric containing soil.

21. An isotropic liquid detergent composition comprising at least one surfactant, from 1 to 25 weight percent of at least one hydrotrope based on the total weight of the liquid detergent composition, and from 0.1 to 75 weight percent, based on the total weight of the liquid detergent composition, of a water-soluble or water-dispersible polymer having a hydrophilic back bone component having pendant acid functionality and a terminal hydrophobic fragment of a chain transfer agent, wherein the polymer is the polymerization product of from about 50 to about 99.9 weight percent, based on the total weight of monomers, of a ethylenically unsaturated acid monomer, from about 0.1 to about 50 weight percent, based on the total weight of monomers, of a ethylenically unsaturated comonomer, and a $C_3$ to $C_{24}$ chain transfer agent which is selected from the group consisting of a mercaptan, amine, alcohol, and combinations thereof, provided that the chain transfer agent does not contain a polyalkyleneoxy group, and wherein said liquid detergent consists of a clear, single phase.

22. The isotropic liquid detergent composition according to claim 21 wherein the ethylenically unsaturated comonomer is selected from the group consisting of anhydrides, vinyl esters, alkyl esters of acrylic and methacrylic acid, substituted or unsubstituted mono and dialkyl esters of unsaturated dicarboxylic acids or carboxylic acids, vinyl aromatics, unsubstituted or substituted acrylamides, cyclic monomers, monomers containing alkoxylated side chains, $\alpha$-olefins, vinyl amide monomers, and combinations thereof.

23. The isotropic liquid detergent composition according to claim 22 wherein the ethylenically unsaturated comonomer is selected from the group consisting of acrylamide and vinyl acetate.

24. The isotropic liquid detergent composition according to claim 21 wherein the water-soluble or water-dispersible polymer comprises 60 to about 90 weight percent of the ethylenically unsaturated acid monomer and 10 to 40 weight percent of the ethylenically unsaturated comonomer.

25. The isotropic liquid detergent composition according to claim 24 wherein the water-soluble or water-dispersible polymer comprises 70 to about 80 weight percent of the ethylenically unsaturated acid monomer and 20 to 30 weight percent of the ethylenically unsaturated comonomer.

* * * * *